US010665381B2

(12) United States Patent
Kobayashi et al.

(10) Patent No.: US 10,665,381 B2
(45) Date of Patent: May 26, 2020

(54) STATIONARY INDUCTION APPARATUS CORE

(71) Applicant: Hitachi, Ltd., Chiyoda-ku, Tokyo (JP)

(72) Inventors: Chie Kobayashi, Tokyo (JP); Naoyuki Kurita, Tokyo (JP); Akira Yamagishi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 100 days.

(21) Appl. No.: 15/861,731

(22) Filed: Jan. 4, 2018

(65) Prior Publication Data

US 2018/0204669 A1 Jul. 19, 2018

(30) Foreign Application Priority Data

Jan. 19, 2017 (JP) ..... 2017-007353

(51) Int. Cl.

| | |
|---|---|
| ***H01F 27/24*** | (2006.01) |
| ***H01F 27/34*** | (2006.01) |
| ***H01F 27/25*** | (2006.01) |
| ***H01F 27/245*** | (2006.01) |
| ***H01F 27/26*** | (2006.01) |

(Continued)

(52) U.S. Cl.

CPC ..... *H01F 27/34* (2013.01); *H01F 3/02* (2013.01); *H01F 3/04* (2013.01); *H01F 3/10* (2013.01); *H01F 3/14* (2013.01); *H01F 27/245* (2013.01); *H01F 27/2455* (2013.01); *H01F 27/25* (2013.01); *H01F 27/263* (2013.01); *H01F 41/0226* (2013.01); *H01F 41/0233* (2013.01); *H01F 2003/106* (2013.01)

(58) Field of Classification Search

USPC ..... 336/216

See application file for complete search history.

(56) References Cited

U.S. PATENT DOCUMENTS 4,592,133 A * 6/1986 Grimes ..... H01F 41/02 242/434.7

6,844,799 B2 * 1/2005 Attarian ..... G01R 15/183 335/18

(Continued)

FOREIGN PATENT DOCUMENTS

| | | |
|---|---|---|
| CN | 105895328 A | 8/2016 |
| JP | 57-90917 A | 6/1982 |

(Continued)

OTHER PUBLICATIONS

Taiwanese-language Office Action issued in counterpart Taiwanese Application No. 107101817 dated May 24, 2018 (three (3) pages).

Japanese-language Office Action issued in Japanese Application No. 2017-007353 dated Feb. 25, 2020 with English translation (six (6) pages).

*Primary Examiner* — Ronald Hinson

(74) *Attorney, Agent, or Firm* — Crowell & Moring LLP

(57) ABSTRACT

An object of the present invention is to improve a mechanical strength and to ensure a low magnetic loss without using a supporting member even when amorphous ribbons are used for an inner core. To attain the object, a stationary induction apparatus core of the present invention includes an inner core formed from the amorphous ribbons and outer cores formed from silicon steel sheets, the outer cores being disposed on two sides of the inner core in a depth direction as opposed to a standing direction of the inner core in such a manner as to sandwich the inner core therebetween.

12 Claims, 6 Drawing Sheets

(51) Int. Cl.

| | |
|---|---|
| ***H01F 3/14*** | (2006.01) |
| ***H01F 3/02*** | (2006.01) |
| ***H01F 3/04*** | (2006.01) |
| ***H01F 3/10*** | (2006.01) |
| *H01F 41/02* | (2006.01) |

(56) References Cited

U.S. PATENT DOCUMENTS

| | | | | |
|---|---|---|---|---|
| 2002/0157239 | A1* | 10/2002 | Ngo ..... | H01F 27/266<br>29/606 |
| 2014/0292471 | A1 | 10/2014 | Ho et al. | |
| 2016/0247621 | A1 | 8/2016 | Ono et al. | |
| 2018/0040409 | A1 | 2/2018 | Oono et al. | |

FOREIGN PATENT DOCUMENTS

| | | | |
|---|---|---|---|
| JP | 61-198706 | A | 9/1986 |
| JP | 62-128510 | A | 6/1987 |
| JP | 63-137917 | U | 9/1988 |
| JP | 3-190112 | A | 8/1991 |
| JP | 4-250604 | A | 9/1992 |
| JP | 8-88128 | A | 4/1996 |
| JP | 2002-343647 | A | 11/2002 |
| JP | 2008-166636 | A | 7/2008 |
| JP | 2016-174113 | A | 9/2016 |
| TW | 201631611 | A | 9/2016 |

* cited by examiner

STATIONARY INDUCTION APPARATUS CORE

CLAIM OF PRIORITY

The present application claims priority from Japanese Patent, application serial No. 2017-7353, filed on Jan. 19, 2017, the content of which is hereby incorporated by reference into this application.

BACKGROUND OF THE INVENTION

1. Field of the Invention

The present invention relates to a stationary induction apparatus core, and particularly relates to a stationary induction apparatus core suited as a core that uses amorphous ribbons and silicon steel sheets for a stationary induction apparatus such as a transformer or a reactor.

2. Description of the Related Art

In recent years, for one type of stationary induction apparatus core that is, for example, an energy saving transformer core, an amorphous magnetic material with a low magnetic loss and excellent magnetic properties has been used. Amorphous ribbons used in the transformer core are produced by rapidly quenching a magnetic alloy melt, so that the amorphous ribbons are quite low in magnetic loss and exhibits excellent magnetic properties.

However, the amorphous ribbons forming the core have properties of being hard and brittle, and hundreds of ribbons at a thickness of 25 μm are stacked for forming the core. Owing to this, a sufficient mechanical strength and sufficient rigidity cannot be obtained. Thus, unlike silicon steel sheets, the amorphous ribbons are difficult to self-stand.

To address the problem, a polyphase transformer core described in, for example, JP-1996-88128-A uses, as materials configuring the polyphase transformer core, amorphous ribbons that effectively reduce a magnetic loss and that are wound up as one inner core, and silicon steel sheets wound up or stacked as one outer core. By forming a compound structure of the inner and outer cores, the invention described in JP-1996-088128-A intends to provide both the low magnetic loss properties and improved mechanical strength and rigidity of the core, thereby ensuring workability at a time of assembly work.

JP-1996-088128-A describes a method of overcoming insufficiencies of the mechanical strength and the rigidity of the stationary induction apparatus core as follows. The amorphous ribbons that effectively reduce the magnetic loss and that are wound up as the inner core and the silicon steel sheets wound up or stacked as the outer core are used. By forming the compound structure of the inner and outer cores, the invention described in JP-1996-088128-A intends to provide both the low magnetic loss characteristics and improved mechanical strength and rigidity of the core, thereby ensuring the workability at the time of assembly work.

Generally, a saturation flux density of the amorphous ribbon at 50 Hz is about 1.6 T and a saturation flux density of the silicon steel sheet is about 2.0 T. Owing to this, to average a magnetic flux density distribution within the core, it is advantageous to dispose the amorphous ribbons on the inner core and such a configuration is normally adopted.

However, when the amorphous ribbons are used for the inner core, a supporting member (for example, an SUS material) is necessary because of difficulty in malting the amorphous ribbons self-standing and this supporting member possibly, disadvantageously causes an increase in a stray loss. Furthermore, since a load of the silicon steel sheets is applied to the amorphous ribbons, the load possibly, disadvantageously causes an increase in the magnetic loss.

SUMMARY OF THE INVENTION

The present, invention has been achieved in the light of the above respects. An object of the present invention is to provide a stationary induction apparatus core capable of improving a mechanical strength and ensuring a low magnetic loss without using a supporting member even when amorphous ribbons are used for an inner core.

To attain the object, a stationary induction apparatus core of the present invention includes an inner core formed from amorphous ribbons and outer cores formed from silicon steel sheets, the outer cores being disposed on two sides of the inner core in a depth direction as opposed to a standing direction of the inner core in such a manner as to sandwich the inner core therebetween.

According to the present embodiment, it is possible to obtain a stationary induction apparatus core capable of improving a mechanical strength and ensuring a low magnetic loss without using a supporting member even when amorphous ribbons are used for an inner core.

DESCRIPTION OF THE PREFERRED EMBODIMENTS

Figure 1A:
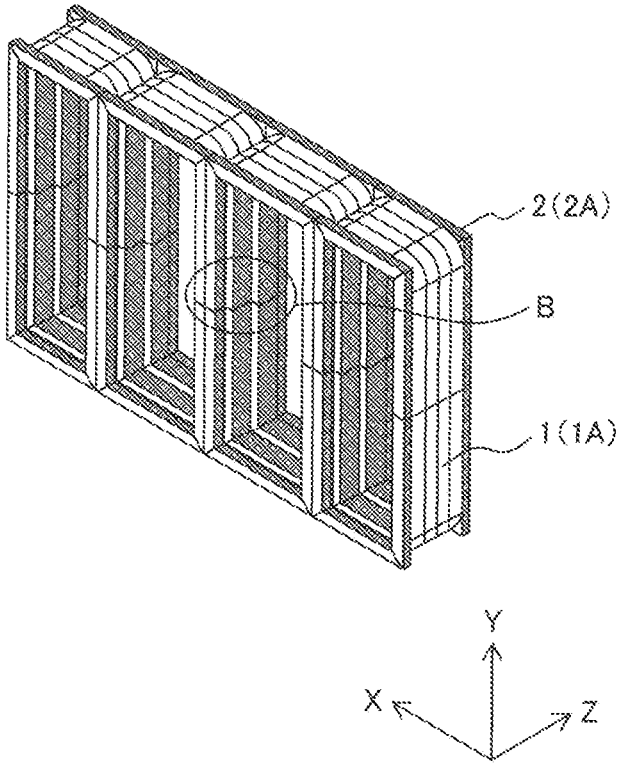
FIG. 1A is a perspective view showing a first embodiment of a stationary induction apparatus core according to the present invention.

A stationary induction apparatus core according to the present invention will be described hereinafter on the basis of embodiments shown in the drawings. It is noted that same reference characters are used to denote same constituent components in the embodiments.

First Embodiment

Figure 1B:
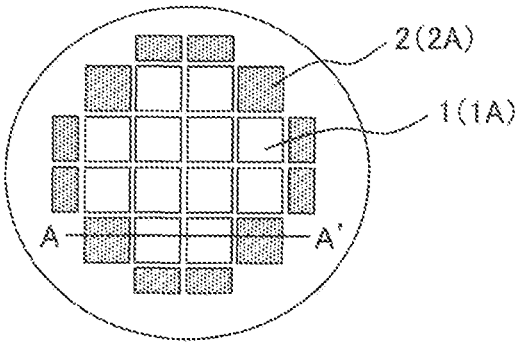
FIG. 1B is a detailed cross-sectional view of a part B of FIG. 1A.

FIGS. 1A and 1B show a first embodiment of the stationary induction apparatus core according to the present invention. FIG. 1A shows the core viewed obliquely, and FIG. 1B is a detailed cross-sectional view of a part B of FIG. 1A in which a cross-section of a magnetic leg is partially enlarged to make an internal configuration of the magnetic leg clear.

For the stationary induction apparatus core in the present embodiment, it is defined in FIG. 1A that an arrow X direction is a lateral direction, an arrow Y direction is a longitudinal direction, and an arrow Z direction is a width direction.

As shown in FIGS. 1A and 1B, the stationary induction apparatus core in the present embodiment is generally configured with inner cores 1 formed from amorphous ribbons and outer cores 2 formed from silicon steel sheets, the outer cores 2 being disposed on two sides of each inner core 1 in a depth direction (width direction: the arrow Z direction of FIG. 1A) as opposed to a standing direction of the inner cores 1 (longitudinal direction: the arrow Y direction of FIG. 1A) in such a manner as to sandwich the inner cores 1 between the outer cores 2.

In the stationary induction apparatus core in the present embodiment, the inner cores 1 are wound cores 1A each obtained by winding up the amorphous ribbons into a generally rectangular shape, and the outer cores 2 are stacked cores 2A each obtained by stacking the silicon steel sheets while being offset stepwise by a constant amount. It is noted that the inner cores 1 may be each molded into the generally rectangular shape by stacking long amorphous ribbons and then butting two ends together. The outer cores 2 may be each formed by winding up a silicon steel sheet into a generally rectangular shape.

Generally, a thickness of one amorphous ribbon is as small as several tens μm and hundreds of amorphous ribbons are stacked. Owing to this, it is difficult to make the amorphous ribbons self-standing. On the other hand, since the silicon steel sheet is approximately ten times as thick as the amorphous ribbon, it is possible to make the silicon steel sheets into a self-standing configuration.

It is, therefore, possible to suppress a deformation of a shape of each inner core 1 formed from the amorphous ribbons by disposing the outer cores 2 formed from the silicon steel sheets on an outer periphery of the inner core 1 formed from the amorphous ribbons in such a manner as to sandwich the inner core 1 between the outer cores 2.

Figure 2A:
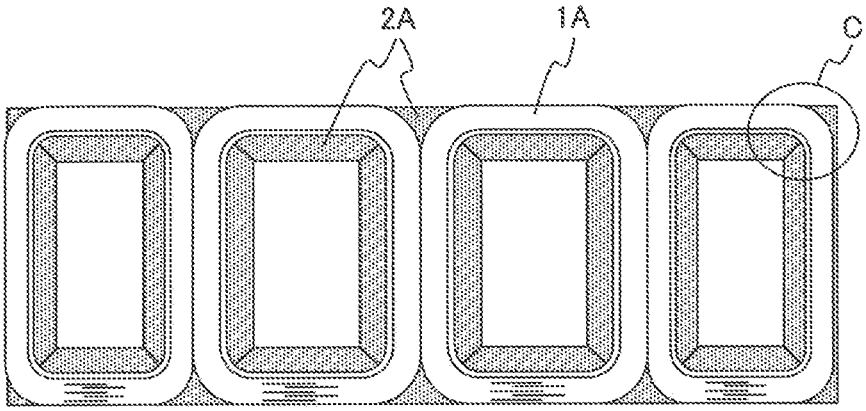
FIG. 2A is a cross-sectional view taken along a line A-A' of FIG. 1B in the first embodiment of the stationary induction apparatus core according to the present invention.
Figure 2B:
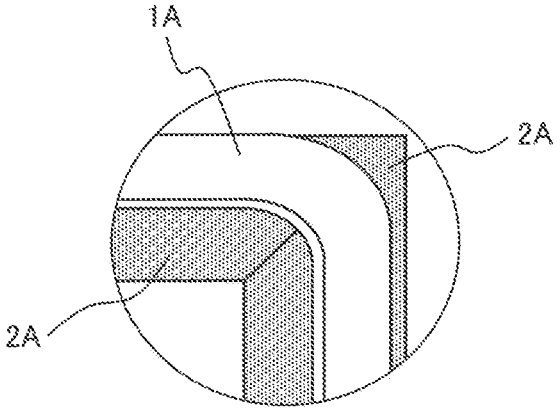
FIG. 2B is an enlarged detail view of a part C of FIG. 2A.

FIG. 2A is a cross-sectional view taken along a line A-A' of FIG. 1B in the first embodiment of the stationary induction apparatus core according to the present invention. That is, FIG. 2A is a sectional view of the stationary induction apparatus core divided into two in the depth direction (cross-sectional view taken along the line A-A' of FIG. 1B). FIG. 2B is an enlarged view of a part C of FIG. 2A.

As shown in FIG. 2B, allowing an outer peripheral side of each corner portion of the stacked cores 2A formed from the silicon steel sheets to have a curvature makes it possible to avoid concentration of a load of the wound core 1A formed from the amorphous ribbons on the corner portion. It is noted that the corner portions of the stacked cores 2A formed from the silicon steel sheets may be configured to be partially cut off.

Furthermore, causing an insulating material, for example, a pressboard to lie between each wound core 1A formed from the amorphous ribbons and each stacked core 2A formed from the silicon steel sheets makes it possible to protect the wound core 1A and suppress a vibration-caused misalignment and a vibration.

Moreover, the stacked cores 2A formed from the silicon steel sheets are configured to be stacked in a perpendicular direction (the longitudinal direction Y) as opposed to a stacking direction (the width direction Z) of the wound cores 1A formed from the amorphous ribbons.

As in the present embodiment described above, the outer cores 2 (stacked cores 2A) formed from the silicon steel sheets are disposed on the two sides of each inner core 1 (wound core 1A) in the depth direction as opposed to the standing direction of the inner cores 1 (wound cores 1A) in such a manner as to sandwich the inner core (wound core 1A) between the outer cores 2 (stacked cores 2A). The shape of the inner cores 1 (wound core 1A) disposed within each magnetic leg is thereby maintained. In addition, the outer cores 2 (stacked cores 2A) formed from the silicon steel sheets are caused to receive the load of the inner cores 1 (wound cores 1A) formed from the amorphous ribbons sensitive to a stress. It is thereby unnecessary to provide a supporting member that supports the inner cores 1 (wound cores 1A) formed from the amorphous ribbons, and it is, therefore, possible to eliminate the supporting member and reduce a loss caused by the load.

Therefore, according to the present embodiment, it is possible to obtain the stationary induction apparatus core capable of improving a mechanical strength and ensuring a low magnetic loss without using the supporting member even when the amorphous ribbons are used for the inner cores 1.

Second Embodiment

Figure 3A:
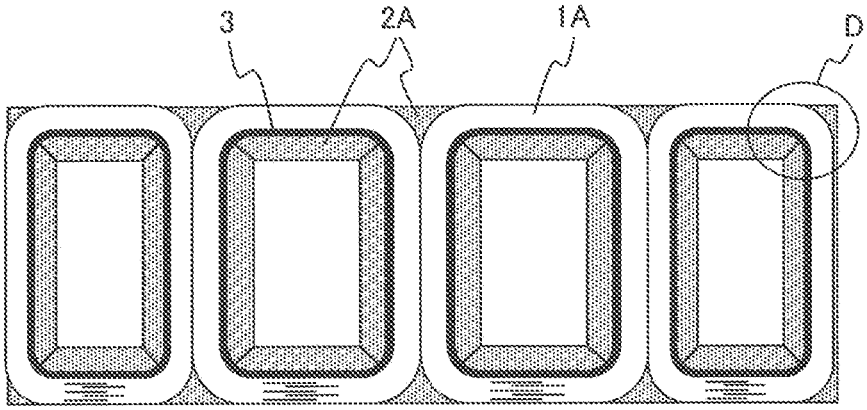
FIG. 3A shows a second embodiment of the stationary induction apparatus core according to the present, invention and corresponds to FIG. 2A.
Figure 3B:
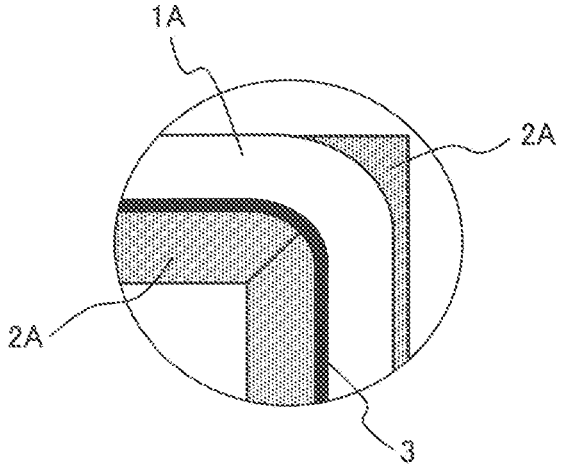
FIG. 3B is an enlarged detail view of a part D of FIG. 3A.

FIGS. 3A and 3B show a second embodiment of the stationary induction apparatus core according to the present invention.

The stationary induction apparatus core in the present embodiment shown in FIGS. 3A and 3B is configured, in addition to a configuration described in the above first embodiment, such that a silicon steel sheet 3 wound into a generally rectangular shape is disposed between an outermost periphery of each stacked core 2A formed from the silicon steel sheets and an innermost periphery of each wound core 1A formed from the amorphous ribbons.

With such a configuration of the present embodiment, it is possible not only to attain similar effects to those of the first embodiment, but also to protect the amorphous ribbons of the wound cores 1A from breakage due to contact with the stacked cores 2 by disposing the silicon steel sheet 3.

Third Embodiment

Figure 4A:
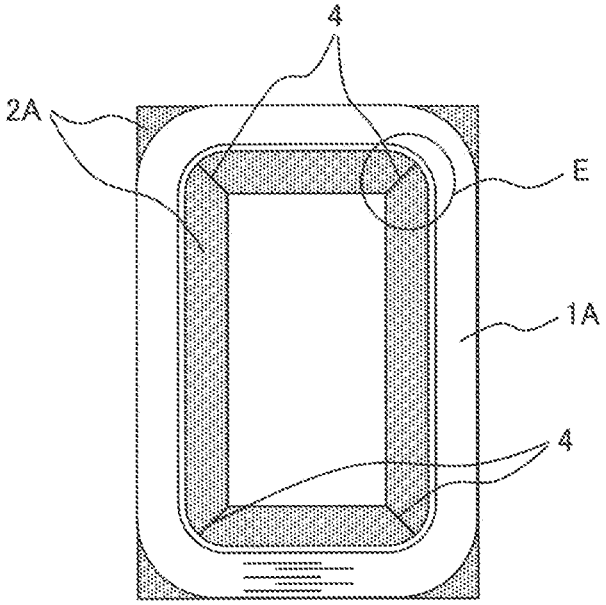
FIG. 4A is a cross-sectional view of one core for showing a third embodiment of the stationary induction apparatus core according to the present invention.
Figure 4B:
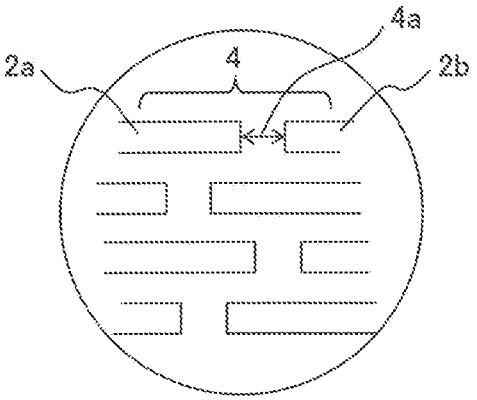
FIG. 4B is an enlarged detail view of a part D of FIG. 4A.

FIGS. 4A and 4B show a third embodiment of the stationary induction apparatus core according to the present invention.

The stationary induction apparatus core in the present embodiment shown in FIGS. 4A and 4B is configured, in addition to the configuration described in the above first embodiment, such that a gap 4*a* formed between silicon steel sheets 2*a* and 2*b* in a step-lap joint section 4 formed in each corner portion of the stacked core 2A formed from the silicon steel sheets is made large to have a gap length at which a magnetic resistance of the wound cores 1A is equal to that of the stacked cores 2A.

With such a configuration of the present embodiment, it is possible not only to attain the similar effects to those of the first embodiment, but also to make the magnetic resistance of the wound cores 1A formed from the amorphous ribbons generally equal to that of the stacked cores 2A formed from the silicon steel sheets and to reduce a deviation of flux densities in the core.

Fourth Embodiment

Figure 5:
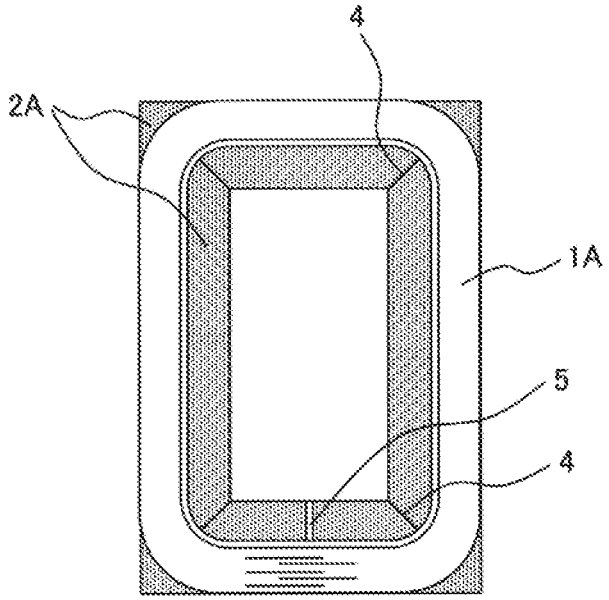
FIG. 5 is a cross-sectional view of one core for showing a fourth embodiment of the stationary induction apparatus core according to the present invention.

FIG. 5 shows a fourth embodiment of the stationary induction apparatus core according to the present invention.

The stationary induction apparatus core in the present embodiment shown in FIG. 5 is configured, in addition to the configuration described in the above first embodiment, such that a yoke section that is each stacked core 2A formed from the silicon steel sheets is divided into two and a gap is provided in a core joint section 5 formed by dividing the yoke section into two. The core joint section 5 may be either a step-lap joint or a butt-lap joint.

With such a configuration of the present embodiment, it is possible not only to attain the similar effects to those of the first embodiment, but also to make the magnetic resistance of the wound cores 1A formed from the amorphous ribbons generally equal to that of the stacked cores 2A formed from the silicon steel sheets and to reduce a deviation of flux densities in the core by providing the gap in the core joint section 5 and adjusting the gap length of this gap.

A portion in which the gap is provided is not always limited to a center of the yoke section but may be a portion near each end portion or a leg portion of the yoke section.

Fifth Embodiment

Figure 6A:
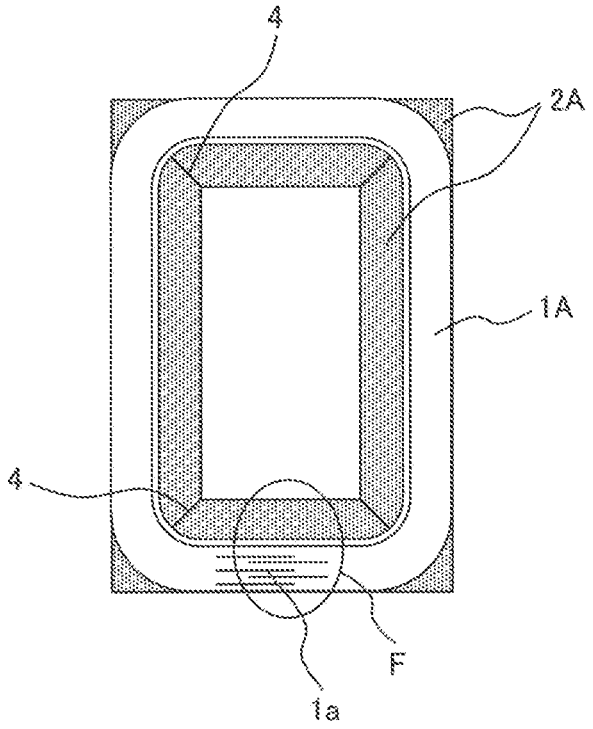
FIG. 6A is a cross-sectional view of one core for showing a fifth embodiment of the stationary induction apparatus core according to the present invention.
Figure 6B:
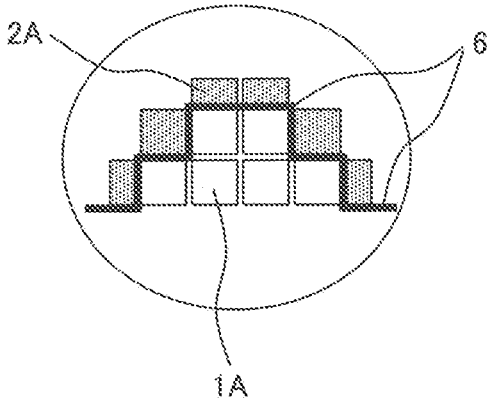
FIG. 6B is a detailed cross-sectional view of a part F of FIG. 6A.

FIGS. 6A and 6B show a fifth embodiment of the stationary induction apparatus core according to the present invention.

The stationary induction apparatus core in the present embodiment shown in FIGS. 6A and 6B is configured, in addition to the configuration described in the above first embodiment, such that, a load distribution guide 6 is provided between each wound core 1A formed from the amorphous ribbons and each stacked core 2A formed from the silicon steel sheets.

With such a configuration of the present embodiment, it is possible not only to attain the similar effects to those of the first embodiment, but also to distribute the load of each stacked core 2A formed from the silicon steel sheets applied to a lap section 1*a* of each wound core 1A formed from the amorphous ribbons by the load distribution guide 6 and to prevent an increase in a magnetic loss.

The present invention is not limited to the embodiments described above but encompasses various modifications. For example, the above embodiments have been described in detail for facilitating understanding the present invention, and the present invention is not always limited to the embodiments having all the configurations described above. Furthermore, the configuration of a certain embodiment can be partially substituted by the configuration of the other embodiment or the configuration of the other embodiment can be added to the configuration of the certain embodiment. Moreover, for part of the configuration of each embodiment, additions, omissions, and substitutions of the other configurations can be made.

What is claimed is:

1. A stationary induction apparatus core, comprising:
an inner core formed from amorphous ribbons; and
outer cores formed from silicon steel sheets, the outer cores being disposed on two sides of the inner core in a depth direction as opposed to a standing direction of the inner core in such a manner as to sandwich the inner core therebetween and on a side of the inner core in a lateral direction of the inner core.

2. The stationary induction apparatus core according to claim 1, wherein
the inner core is a wound core obtained by winding up the amorphous ribbons, and
the outer cores are each a stacked core obtained by stacking the silicon steel sheets while being offset stepwise by a constant amount.

3. The stationary induction apparatus core according to claim 2, wherein
an outer peripheral side of each corner portion of the stacked core is allowed to have a curvature or the corner portion of the stacked core is partially cut off.

4. The stationary induction apparatus core according to claim 2, wherein
an insulating material lies between the wound core and the stacked core.

5. The stationary induction apparatus core according to claim 2, wherein
a silicon steel sheet is disposed between an outermost periphery of the stacked core and an innermost periphery of the wound core.

6. The stationary induction apparatus core according to claim 2, wherein
a yoke section that is the stacked core is divided into two, and a gap is provided in a core joint section formed by dividing the yoke section into two.

7. The stationary induction apparatus core according to claim 2, wherein
a load distribution guide is provided between the wound core and the stacked core.

8. The stationary induction apparatus core according to claim 2, wherein
a step-lap joint section is formed in each corner portion of the stacked core.

9. The stationary induction apparatus core according to claim 8, wherein
a gap formed between the silicon steel sheets in the step-lap joint section has a gap length at which a magnetic resistance of the wound core is equal to a magnetic resistance of the stacked core.

10. The stationary induction apparatus core according to claim 2, wherein a protective material is disposed between the stacked core and the wound core.

11. The stationary induction apparatus core according to claim 10, wherein the protective material is a silicon steel sheet.

12. The stationary induction apparatus core according to claim 11, wherein the protective material is disposed between an outermost periphery of the stacked core and an innermost periphery of the wound core.

* * * * *